343-700 MS AU 251 EX
4/24/84 OR 4,445,122

United States Patent [19]

Pues

[11] 4,445,122

[45] Apr. 24, 1984

[54] BROAD-BAND MICROSTRIP ANTENNA

[75] Inventor: Hugo F. Pues, Herent, Belgium

[73] Assignee: Leuven Research & Development v.z.w., Belgium

[21] Appl. No.: 248,841

[22] Filed: Mar. 30, 1981

[51] Int. Cl.[3] ..... H01Q 1/38
[52] U.S. Cl. ..... 343/700 MS; 343/851
[58] Field of Search ..... 343/700 MS, 851, 829

[56] References Cited

U.S. PATENT DOCUMENTS

| | | | |
|---|---|---|---|
| 2,387,116 | 10/1945 | Bruce | 343/851 |
| 4,079,268 | 3/1978 | Fletcher | 343/700 MS |
| 4,167,010 | 9/1979 | Kerr | 343/700 MS |
| 4,291,312 | 9/1981 | Kaloi | 343/700 MS |
| 4,320,401 | 3/1982 | Schiavone | 343/700 MS |

*Primary Examiner*—Eli Lieberman
*Attorney, Agent, or Firm*—Lewis H. Eslinger

[57] ABSTRACT

The invention relates to an antenna for the reception of electromagnetic radiation, for example, microwaves emanating from a geo-stationary broadcast-satellite, the antenna comprising a receiving member and a focusing member forcusing the incident radiation thereto, the receiving member comprising at least one receiving element having an insulating substrate plate, a conductive plate applied to one surface thereof and a flat, conductive pattern applied to the other surface thereof, the conductive plate and the conductive pattern being coupled with connecting terminals, wherein an impedance matching circuit is connected between the receiving member and the connecting terminals for increasing the bandwidth of the antenna.

4 Claims, 4 Drawing Figures

Figure 3:
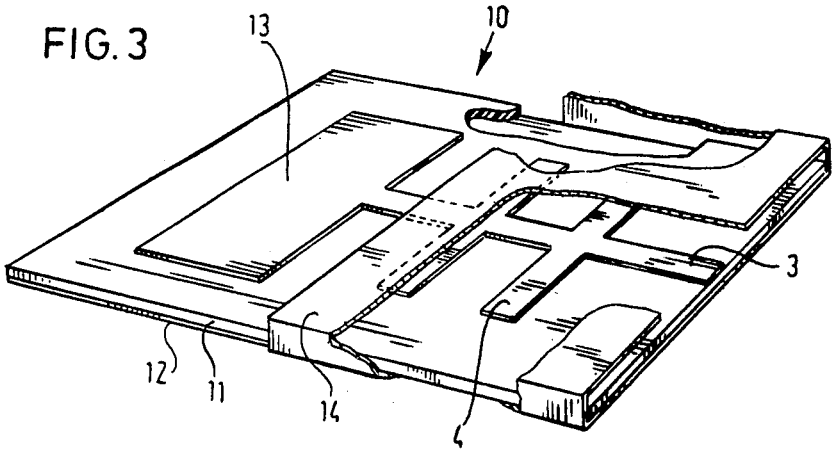

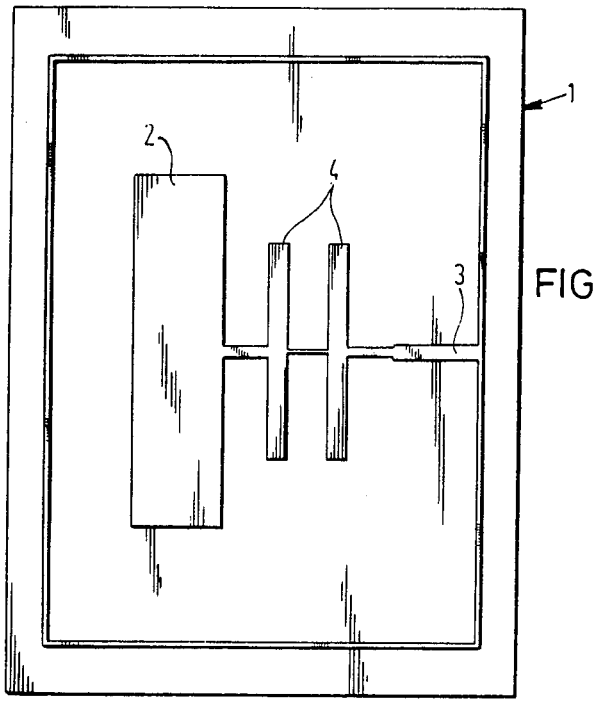
FIG.1
FIG. 2
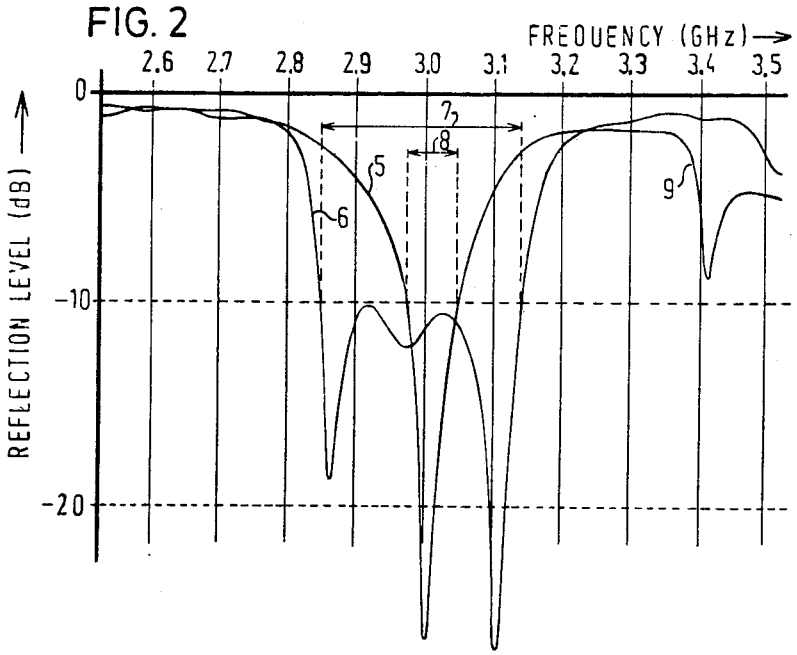

BROAD-BAND MICROSTRIP ANTENNA

The invention relates to an antenna for the reception of electromagnetic radiation, for example, microwaves emanating from a geo-stationary broadcast-satellite, said antenna comprising a receiving member and a focusing member focusing the incident radiation thereto, said receiving member comprising at least one receiving element having an insulating substrate plate, a conductive plate applied to one surface thereof and a flat, conductive pattern applied to the other surface thereof, said conductive plate and said conductive pattern being coupled with connecting terminals.

An antenna of the kind set forth is described in Dutch Patent Application 80.06425.

The known antenna is of the resonator type, which is based on a resonance phenomenon, as a result of which the bandwidth is quite limited, namely in the order of magnitude of a few percents of the resonance frequency. A relative bandwidth of 2 to 3%, for example, is typical.

With regard to the concept of "bandwidth of an antenna" it is noted that it is defined as that frequency band in which the antenna maintains its properties to the desired, at least sufficient extent. In accordance with the specific use the maintaining of one property or the other may be considered to be of decisive importance. The bandwidth is then determined in relation to said most relevant property.

The aforesaid limitation of the attainable bandwidth may be an important disadvantage. Most uses in telecommunication, for example, for radar purposes, satellite communication and so on require bandwidths of the order of 5 to 10%. For example, for the reception of television broadcast satellites the international standards prescribe a bandwidth of 800 MHz with a central frequency of 12.1 MHz, i.e. a relative bandwidth of about 6.6%.

In order to achieve the desired enlargement of the bandwidth it is possible to optimize the design of the antenna. For this optimalization a number of design parameters, for example, the thickness of a substrate and the relative permittivity thereof are selected to be as favourable as possible in their mutual relationship. In this way it is under advantageous conditions possible to double the bandwidth, for example, to 4 to 6% without substantial disturbance of less essential properties.

It is furthermore possible to use several micro-strip resonator elements, each of which covering part of the frequency band. There may, for example, be employed the so-called logarithmically periodical antennas. Without discussing the details of such a design, it should be noted that the "feeding network" brings about large problems. However, in principle it is possible to obtain large bandwidths, for example, of more than 10%, be it with the great disadvantage that the original single resonator antenna is replaced by an array of several different elements.

With respect to the two aforesaid solutions it is noted that the first solution does not provide adequate enlargement of the relative bandwidth, whereas the second solution is, indeed, capable of doing so be it at the expense of the disadvantage that the antenna-structure is considerably more complicated, takes more place, and hence is more expensive and probably less reliable in practice.

The invention has for its object to construct a resonator antenna of the type described in a manner such that a relative bandwidth of about 5 to 10% can be attained, while maintaining the desired radiation properties.

A further object of the invention is to provide an antenna which has a simple structure and can thus be manufactured at low cost, while being reliable in practice.

The invention is based on the following considerations and observations:

1. The behaviour of the input impedance of an antenna as a function of frequency can be influenced by an impedance matching circuit. In principle this permits increasing the bandwith, which is determined in this case in relation to the impedance matching, by a factor 4 to 8.

2. With conventional antennas, for example horn antennas, the technique referred to sub 1 is not often employed, since the required matching circuits can be manufactured only with great difficulty. This drawback, however, does not apply to integrated antennas in which it is technologically no problem to etch an adequate filter network, for example, on the same substrate. Such a solution has, up to the present, not been put forward nor even has been suggested in any publication.

3. In earlier experiments it has been found that in micro-strip resonator antennas the impedance matching constitutes by far the most limiting factor in determining the bandwidth. Namely, the other important properties such as antenna gain, radiation pattern, polarization and so on are maintained in a much larger frequence range than the impedance matching.

On the basis of the above-mentioned considerations and observations the invention provides an antenna of the type set forth in the preamble, in which an impedance matching circuit is arranged between the receiving member and the connecting terminals. Said impedance matching network preferably comprises an insulating substrate plate, a conductive plate applied to one surface of the former and a flat, conductive pattern on the other surface. A simple embodiment is characterized by a substrate plate common to the receiving element and the impedance matching network.

The influence of the presence of the impedance matching circuit on the radiation i.e. directional patterns may be avoided by using a screening or a double-layer embodiment of the matching circuit. Such double-layer embodiment may comprise two isolating substrate plates, a flat conducting pattern therebetween and conducting plates on the outer surfaces, respectively.

Figure 4:
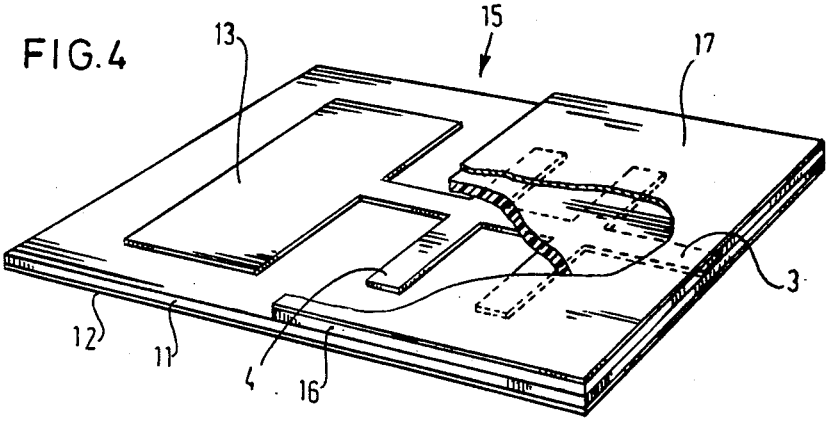

The invention will now be explained with reference to the drawing of some exemplary embodiments. The drawing shows in FIG. 1 a plan view of an aerial in accordance with the invention;

FIG. 2 a reflectogram of the aerial shown in FIG. 1 with and without an impedance matching network respectively;

FIG. 3 a perspective view, partly broken away, or an embodiment in which a screening is added to the impedance matching circuit; and FIG. 4 a perspective view, partly broken away, of an alternative embodiment, in which said impedance matching circuit comprises: two isolating substrate plates; a flat conductive pattern sandwiched between said two substrate plates; and conductive plates on the two outer surfaces of said substrate plates, respectively.

In the drawings all corresponding parts and elements are indicated by the same reference numerals.

FIG. 1 illustrates a micro-strip resonator antenna 1. This antenna comprises a receiving member 2, connecting terminals 3 as well as an impedance matching circuit 4 connected between the receiving member 2 and the connecting terminals 3.

In this specific embodiment the width of the receiving member is 120 mms, whereas the length is 31.5 mms and the height 1.57 mms. The relative permittivity of the substrate having the conductive pattern 2,3,4 amounts to 2.2. The resonance frequency is 3.020 MHz.

With reference to FIG. 2 it will be explained more fully that the bandwidth of the receiving member is 2.5%, whereas the bandwidth of the combined unit of the receiving member and the impedance matching circuit is 10%.

FIG. 2 shows two reflection diagrams designated by reference numerals 5 and 6, respectively. The reflectogram 5 corresponds to the receiving member 2, whereas the reflectogram 6 corresponds to the combination of the receiving member 2 and the impedance matching circuit 4.

The abscissa corresponds to the frequency and the ordinate to the relative reflection level. The frequency range concerned extends from 2.6 GHz to 3.5 GHz.

As a criterion for the desired properties a reflection level of less than −10 dB is assumed. It will be obvious that this criterion for the curve 5 corresponds to the bandwidth designated by 7 and for the curve 6 to the bandwidth designated by reference numeral 8.

It should be noted that the impedance matching circuit 4 is designed as an approximation of the Chebyshev circuit.

It is remarked that the non-matched antenna has a mode 9 at about 3.42 GHz, which is completely suppressed by using the matching circuit 4. This illustrates the ample activity of the impedance matching circuit.

The exemplary embodiment according to FIG. 3 comprises an isolating substrate plate 11, a conductive plate 12 on one surface thereof and a flat conductive pattern 13 on the other surface thereof, terminals 3, and an impedance matching circuit 4 connected between said pattern 13 and said terminals 3. Over the circuit 4 in spaced relation therewith arranged in a screening plate 14 which is connected with the above-mentioned conductive plate 12 by spacing elements having the form of conductive side plates 12. As a result of this construction deterioration of the directional characteristics of the antenna 10 by the circuit 4 is avoided.

In the example 15 as viewed in FIG. 4 over the impedance matching circuit 4 a second isolating substrate-plate 16 is arranged in such a way that the circuit 4 is sandwiched between substrate plates 11 and 16. On the whole outer surface of the substrate-plate 16 a conductive plate 17 is arranged. As is the case for the conductive plate 12 according to FIG. 3 the conductive plate 17 is operative in preventing the circuit 4 from adversely affecting the directional characteristics of the antenna.

The invention is not limited to the embodiments described. For example, the receiving member may be of any other appropriate type, for example, of the gap type, the dipole type and so forth.

Moreover, the matching circuit may be of a quite different type than that of the embodiment described. It is imaginable, for example, to use stub filters, filters comprising coupled lines, and so on.

The receiving member in conjunction with the matching circuit may, as an alternative, operate as a basic element in an array-element of a phased-array antenna.

Finally, it is emphasized that, where reference is made to a receiving element exactly the same principles according to the invention apply to a transmitter antenna, since an antenna is a reversible dipole.

What I claim is:

1. An antenna for the reception of electro-magnetic radiation, comprising a receiving member including at least one receiving element having an insulating substrate plate with a conductive plate applied to one surface thereof, a flat, conductive rectangular pattern applied to the other surface thereof, at least one connecting terminal for coupling said conductive plate and said conductive pattern, an impedance matching circuit including at least two parallel conductive strips connected between the conductive pattern and the at least one connecting terminal for increasing the bandwidth of said antenna.

2. The antenna as claimed in claim 1 in which said impedance matching circuit comprises an insulating substrate plate, a conductive plate applied to one surface thereof and a flat, conductive pattern applied to the other surface thereof.

3. The antenna as claimed in claim 1 which is further characterized by a substrate plate common to the at least one receiving element and the impedance matching circuit.

4. The antenna as claimed in claim 1, in which said impedance matching circuit has a screening means added thereto.

* * * * *